US005950931A

United States Patent [19]

Beatty et al.

[11] Patent Number: 5,950,931

[45] Date of Patent: Sep. 14, 1999

[54] PRESSURE DECAY PASSAGE FOR A FUEL INJECTOR HAVING A TRAPPED VOLUME NOZZLE ASSEMBLY

[75] Inventors: David J. Beatty; Chetan J. Desai, both of Bloomington; George M. Matta, Peoria, all of Ill.

[73] Assignee: Caterpillar Inc., Peoria, Ill.

[21] Appl. No.: 09/016,150

[22] Filed: Jan. 30, 1998

[51] Int. Cl.[6] ..... F02M 45/00

[52] U.S. Cl. ..... 239/533.8; 239/533.9

[58] Field of Search ..... 239/503.8, 533.9

[56] References Cited

U.S. PATENT DOCUMENTS

| | | | |
|---|---|---|---|
| 3,075,707 | 1/1963 | Rademaker | 239/533.8 X |
| 3,257,078 | 6/1966 | Mekkes | 239/533.8 X |
| 3,282,512 | 11/1966 | Bluhm et al. | 239/533.8 |
| 4,684,067 | 8/1987 | Cotter et al. | 239/533.8 X |
| 4,836,454 | 6/1989 | Gaskell | 239/533.9 |
| 4,872,614 | 10/1989 | Greeves | 239/533.9 |
| 4,917,306 | 4/1990 | Gaskell | 239/533.9 |
| 5,035,221 | 7/1991 | Martin | 123/451 |
| 5,167,370 | 12/1992 | Henkel | 239/533.8 |
| 5,429,309 | 7/1995 | Stockner | 239/533.8 |
| 5,487,508 | 1/1996 | Zuo | 239/533.9 X |
| 5,833,146 | 11/1998 | Hefler | 239/533.8 |
| 5,868,317 | 2/1999 | English | 239/533.8 X |
| 5,871,155 | 2/1999 | Stockner et al. | 239/533.9 X |

FOREIGN PATENT DOCUMENTS

| | | |
|---|---|---|
| 0 818 623 A1 | 1/1998 | European Pat. Off. . |
| 0 844 384 A1 | 5/1998 | European Pat. Off. . |

*Primary Examiner*—Lesley D. Morris
*Attorney, Agent, or Firm*—Michael McNeil

[57] ABSTRACT

A fuel injector includes an injector body that defines a low pressure space, a trapped volume and a fuel pressurization chamber in fluid communication with a nozzle outlet. A needle valve member is positioned in the injector body and moveable between an inject position in which the fuel pressurization chamber is opened to the nozzle outlet, and a closed position in which the nozzle outlet is blocked to the fuel pressurization chamber. The needle valve member includes a lifting hydraulic surface exposed to fluid pressure in the fuel pressurization chamber, and a closing hydraulic surface exposed to fluid pressure in the trapped volume. At least one of the injector body and the needle valve member define a pressure decay passage extending between the trapped volume and the low pressure space.

20 Claims, 3 Drawing Sheets

EOI = END OF INJECTION
BOI = BEGINNING OF INJECTION

PRESSURE DECAY PASSAGE FOR A FUEL INJECTOR HAVING A TRAPPED VOLUME NOZZLE ASSEMBLY

TECHNICAL FIELD

The present invention relates generally to fuel injectors, and more particularly to nozzle assemblies for fuel injectors that employ a trapped volume above the needle valve member.

BACKGROUND ART

In many fuel injectors, a simple spring biased needle check is used to open and close the nozzle outlet. The needle valve member typically includes at least one lifting hydraulic surface that is acted upon by fuel pressure. A compression spring is positioned to bias the needle toward its closed position. When fuel pressure rises above a valve opening pressure sufficient to overcome the spring, the needle valve member lifts to open the nozzle outlet to commence an injection event. Each injection event ends when fuel pressure drops below a pressure necessary to keep the needle valve open against the action of the biasing spring. When this occurs, the spring pushes the needle valve member downward to its closed position to end the injection event.

An improvement on the simple spring biased needle check is described in U.S. Pat. No. 5,429,309 to Stockner, which improvement is more commonly known as a trapped volume nozzle. In a typical fuel injector employing a trapped volume nozzle, the compression biasing spring is positioned in a closed volume space. During an injection event, high pressure fuel migrates up the outer surface of the needle valve member and into the trapped volume. This raises pressure in the trapped volume relatively high, and sometimes in excess of 20 MPa. The purpose of the trapped volume is to increase the speed at which the needle valve member moves to its closed position at the end of an injection event. Those skilled in the art are well aware that in most instances it is desirable to make an injection event end as abruptly as possible in order to decrease undesirable noise and improve emissions from the engine. The trapped volume nozzle achieves this goal by having the needle valve member pushed toward its closed position at the end of an injection event not only by the force of the biasing spring but also by a hydraulic force due to the pressure in the trapped volume acting on one end of the needle valve member.

Although the concept of a trapped volume nozzle has proved sound in hastening the closure rate of the needle valve member, an undesirable side effect has been observed. In some instances, the relatively high pressure developed in the trapped volume during an injection event is unable to decay to a relatively low pressure between injection events. This has the effect of raising the valve opening pressure for a subsequent injection event since the needle valve member is being held closed by hydraulic pressure in addition to the force of the compression biasing spring. Not only is the valve opening pressure for subsequent injection events raised, but the pressure decay has a tendency to vary significantly between individual injectors so that the valve opening pressure is difficult to predict. The end result of this effect is that the injectors tend to inject less fuel than expected, and the amount injected is somewhat unpredictable.

The present invention is directed to overcoming these and other problems associated with fuel injectors employing trapped volume nozzle technology.

DISCLOSURE OF THE INVENTION

In one embodiment, a fuel injector includes an injector body that defines a low pressure space, a trapped volume and a fuel pressurization chamber in fluid communication with a nozzle outlet. A needle valve member is positioned in the injector body and moveable between an inject position in which the fuel pressurization chamber is open to the nozzle outlet, and a closed position in which the nozzle outlet is blocked to the fuel pressurization chamber. The needle valve member includes a lifting hydraulic surface exposed to fluid pressure in the fuel pressurization chamber, and a closing hydraulic surface exposed to fluid pressure in the trapped volume. At least one of the injector body and the needle valve member define a pressure decay passage extending between the trapped volume and the low pressure space.

In another aspect, a fuel injector includes an injector body that defines a low pressure space, a trapped volume and a fuel pressurization chamber in fluid communication with a nozzle outlet. A needle valve member is positioned in the injector body and is moveable between an inject position in which the fuel pressurization chamber is opened to the nozzle outlet, and a closed position in which the nozzle outlet is blocked to the fuel pressurization chamber. The needle valve member includes a lifting hydraulic surface exposed to fluid pressure in the fuel pressurization chamber, and a closing hydraulic surface exposed to fluid pressure in the trapped volume. At least one of the injector body and the needle valve member define a pressure decay passage extending between the trapped volume and the low pressure space. The pressure decay passage includes a cylindrically shaped pressure decay port defined by the injector body. A compression spring is operably positioned in the injector body to bias the needle valve member toward its closed position.

In still another aspect, a nozzle assembly includes a body defining a fuel circulation passage, a trapped volume and a nozzle chamber in fluid communication with a nozzle outlet. A needle valve member is positioned in the body and moveable between an inject position in which the nozzle chamber is open to the nozzle outlet, and a closed position in which the nozzle outlet is blocked to the nozzle chamber. The needle valve member includes a lifting hydraulic surface exposed to fluid pressure in the nozzle chamber, and a closing hydraulic surface exposed to fluid pressure in the trapped volume. At least one of the injector body and the needle valve member define a pressure decay passage extending between the trapped volume and the fuel circulation passage. The pressure decay passage is sufficiently restrictive to fluid flow that pressure in the trapped volume rises significantly above pressure in the fuel circulation passage by an end of an injection event, but the pressure decay passage is sufficiently open to fluid flow that pressure in the trapped volume drops to said pressure in said fuel circulation passage before a subsequent injection event.

BEST MODE FOR CARRYING OUT THE INVENTION

Figure 2:
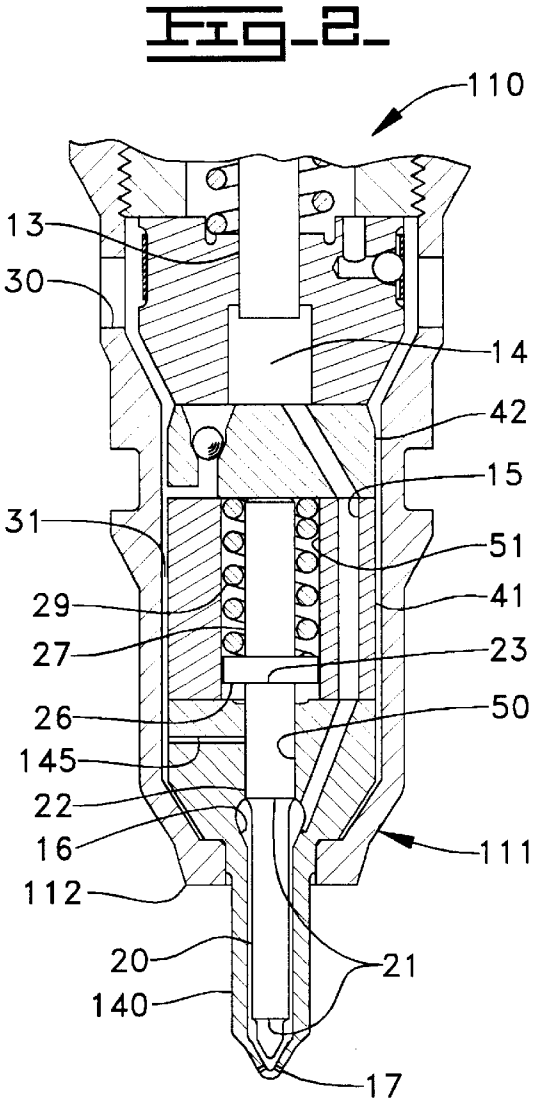
FIG. 2 is a diagrammatic partial sectioned front view of a nozzle assembly portion of a fuel injector according to the present invention.
Figure 1:
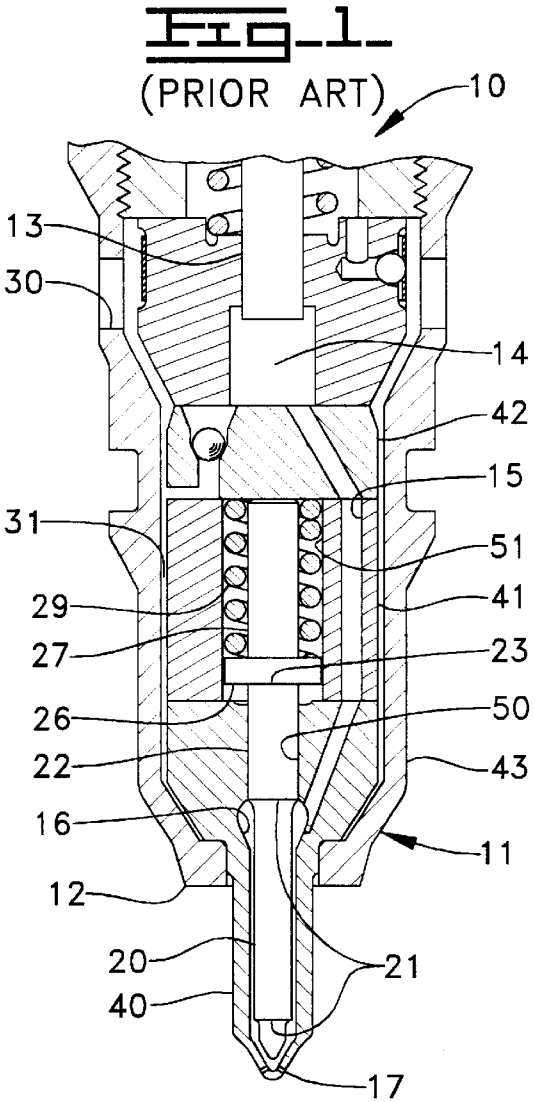
Fig. 1 (PRIOR ART)
FIG. 1 is a diagrammatic partial sectioned front view of a nozzle assembly portion of a fuel injector according to the prior art.

Referring now to FIGS. 1 and 2, identical numerals will be utilized to identify features that are identical both in the prior art fuel injector 10 of FIG. 1 and the fuel injector 110 of the present invention shown in FIG. 2. Fuel injectors 10 and 110 each include respective injector bodies 12 and 112 made up of various components attached to one another in a manner well known in the art. A portion of fuel injectors 10 and 110 are respective nozzle assemblies 11 and 111.

Injector 11 includes a casing component 43 within which are stacked a tip component 40, a spring cage component 41 and a spacer component 42. Together these components define a nozzle supply passage 15 that opens to a nozzle chamber 16, which is in fluid communication with a nozzle outlet 17. In addition, casing component 43 defines a fuel inlet 30 that is in fluid communication with an annular low pressure circulation passage 31, which is defined by the space between tip component 40 and the outer surfaces of spring cage component 41, tip component 40 and spacer component 42. When assembled as shown, tip component 40, spring cage component 41 and spacer component 42 define a trapped volume spring cage 51, which is open to nozzle chamber 16 via a guide bore 50.

In order to substantially isolate trapped volume spring cage 51 from nozzle chamber 16, a needle valve member 20 is positioned in injector body 12 and includes a guide portion 22 with a relatively tight clearance in guide bore 50. In addition to cylindrically shaped guide portion 22, needle valve member 20 includes a pair of lifting hydraulic surfaces 21 that are exposed to fluid pressure in nozzle chamber 16, and a closing hydraulic surface 23 exposed to fluid pressure in trapped volume spring cage 51. Needle valve member 20 includes a spacer 26 is positioned between a compression biasing spring 29 and the closing hydraulic surface end 23. A pin stop 27 rests atop spacer 26 and defines the movement distance of the needle valve member from its closed position to its fully open position, as shown. Pin stop 27, spacer 26 and compression spring 29 are all located within trapped volume 51.

Injector 110 is substantially identical to the prior art injector 10 of FIG. 1 except that its tip component 140 includes a cylindrically shaped pressure decay port 145 extending between low pressure fuel circulation passage 31 and guide bore 50. Pressure decay port 145 preferably opens into guide bore 50 within about 5% of the middle distance between trapped volume 51 and nozzle chamber 16. A pressure decay passage includes the clearance area between guide portion 22 of needle valve member 20 and guide bore 50 as well as pressure decay port 145. Preferably, the pressure decay passage is sufficiently restrictive to fluid flow that pressure in trapped volume 51 rises significantly above fluid pressure in fuel circulation passage 31 by an end of an injection event. Furthermore, the pressure decay passage is preferably sufficiently open to fluid flow that pressure in trapped volume 51 drops to a pressure about equal to fuel pressure in fuel circulation passage 31 before a subsequent injection event begins.

Figure 5:
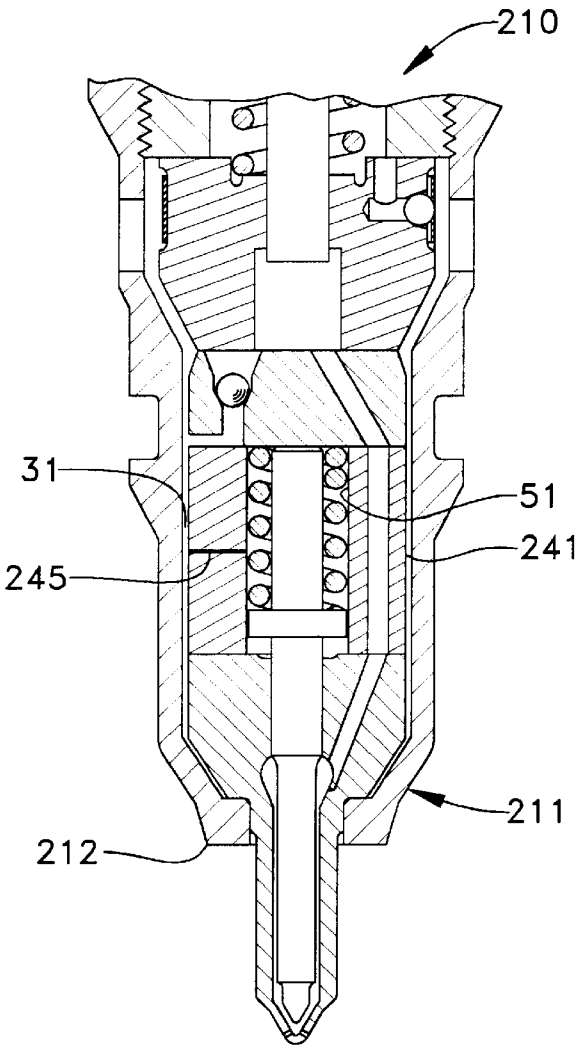
FIG. 5 is a diagrammatic partial sectioned front view of a nozzle assembly portion of a fuel injector according to another embodiment of the present invention.

Referring now to FIG. 5, another embodiment of a fuel injector 210 is substantially identical to the earlier embodiments except that in this case spring cage component 241 includes an extremely small diameter cylindrically shaped pressure decay port 245. Injector 210 includes an injector body 212 that includes a nozzle assembly 211. As with the embodiment of FIG. 2, pressure decay passage 245 is preferably so small in diameter that it restricts fluid flow sufficiently that pressure in the trapped volume 51 rises significantly above fluid pressure in the fuel circulation passage 31 by the end of an injection event. However, the diameter and length of pressure decay passage 245 must be such that it is sufficiently open to fluid flow that pressure in trapped volume 51 drops to that of fuel circulation passage 31 before a subsequent injection event begins.

Figure 6:
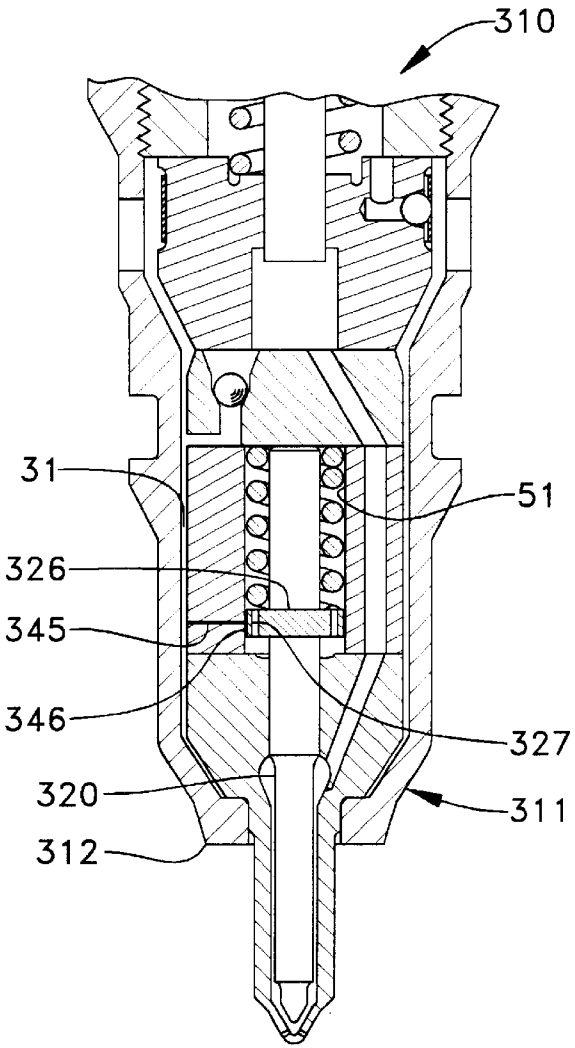
FIG. 6 is a diagrammatic partial sectioned front view of a nozzle assembly portion of a fuel injector according to another embodiment of the present invention.

Referring now to FIG. 6, another embodiment of the fuel injector 310 is substantially identical to the earlier embodiments except that in this case pressure decay port 245 opens in a clearance area 346 adjacent spacer 326. Injector 310 includes an injector body 312 that includes a nozzle assembly 311. As with the previous embodiments, the pressure decay passage is preferably sufficiently restrictive to flow that relative high pressures can be achieved in the trapped volume 51. However, the pressure decay passage is preferably sufficiently unrestrictive to fluid flow that pressure in the trapped volume 51 decays down to about the low pressure in fuel circulation passage 31 between injection events. In this embodiment, these goals can be optimized by adjusting the clearance area 346 between spacer 326 and the wall of trapped volume 51, by adjusting the diameter of decay port 345, and by adjusting the location where port 345 opens into trapped volume 51 relative to spacer 326. In order to prevent the possibility of hydraulic lock and/or cavitation, when the needle valve member 320 is lifting, spacer 326 includes a pair of fluid displacement holes 327.

INDUSTRIAL APPLICABILITY

Each injection event is initiated when plunger 13 is driven downward by some means, such as a cam driven tappet or a hydraulically driven intensifier piston. When plunger 13 moves downward, fuel in fuel pressurization chamber 14 rises rapidly. This fuel pressure is communicated to nozzle chamber 16 via nozzle supply passage 15. As plunger 13 continues its downward stroke, fuel pressure eventually reaches a valve opening pressure acting on lifting hydraulic surfaces 21 that is sufficient to overcome compression biasing spring 29. At the same time as needle valve member 20 begins to open, fuel pressure migrates up guide bore 50 and begins to raise pressure in trapped volume 51. It being understood that a portion of the fuel pressure leaks out of pressure decay port 145. In addition, some inevitable leakage occurs due to machining limitations that exist at the joinder of pin component 140, spring cage component 41 and spacer component 42.

As the injection event continues, fuel leaves the fuel injector through nozzle outlet 17. At the same time, fuel pressure continues to build in trapped volume 51. The end of an injection event occurs when plunger 13 ceases its downward movement, which results in a rapid drop in fuel pressure. When this occurs, the hydraulic forces acting on lifting surfaces 21 are insufficient to hold needle valve 20 in its upward open position against the downward force produced by compression spring 29 and the hydraulic force acting on closing hydraulic surface 23. This causes needle valve 20 to move downward quickly toward its closed position to provide a desired abrupt end to an injection event.

Figure 4:
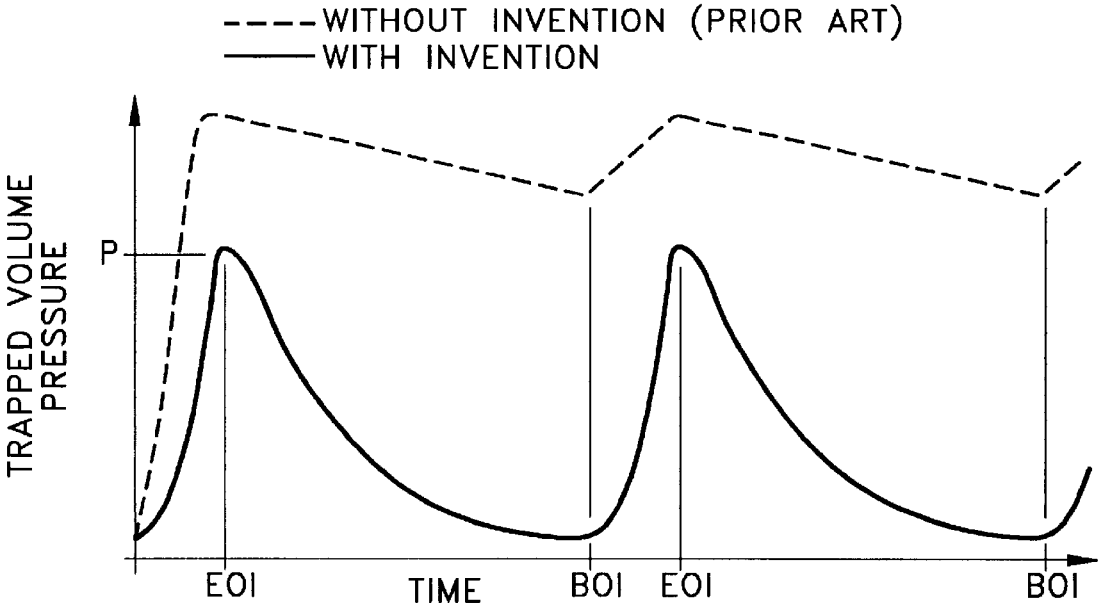
FIG. 4 is a graph of pressure in the trapped volume versus time for a fuel injector with and without the present invention.

Between injection events, the relatively high pressure in trapped volume 51 migrates down the guide bore 50 and into the low pressure area of fuel circulation passage 31 via pressure decay port 145. In the case of the embodiment of FIG. 5, the pressure in trapped volume 51 decays directly into fuel circulation passage 31 via pressure decay passage 245. In the case of the embodiment shown in FIG. 6, the pressure in trapped volume 51 decays along clearance area 346 and then directly into fuel circulation passage 31 via pressure decay port 345. This behavior is illustrated in FIG. 4 and is contrasted against the lack of sufficient pressure decay occurring in the trapped volume 51 of the prior art fuel injector 10.

In the case of fuel injector 10, higher pressures are achieved in trapped volume 51 but this pressure is unable to decay sufficiently between injection events. However, in the case of injectors 110, 210 and 310 of the present invention, the pressure decay passages are sufficiently sized that substantially all of the built up pressure in trapped volume 51 decays between injection events. At the same time, the pressure decay passages are sufficiently small and restrictive to fluid flow that pressure in the trapped volume rises substantially to provide hydraulic assistance at the end of an injection event in closing the needle valve member 20.

The embodiment of FIG. 2 is preferred since the performance of this injector is very insensitive to the location of the pressure decay port 145 provided that it opens into guide bore 50 within about 5% of the middle location between trapped volume 51 and nozzle chamber 16. If the guide port is moved upward substantially that it opens into guide bore 50 closer to trapped volume 51, the pressure built up in trapped volume 51 will decay faster and the build up of pressure in the trapped volume will be undermined. On the other hand, if the pressure decay port 145 opens into guide bore 50 closer to the nozzle chamber, the pressure built up in trapped volume 51 decays slower and the fuel pressure builds up at a lower rate during an injection event.

Figure 3:
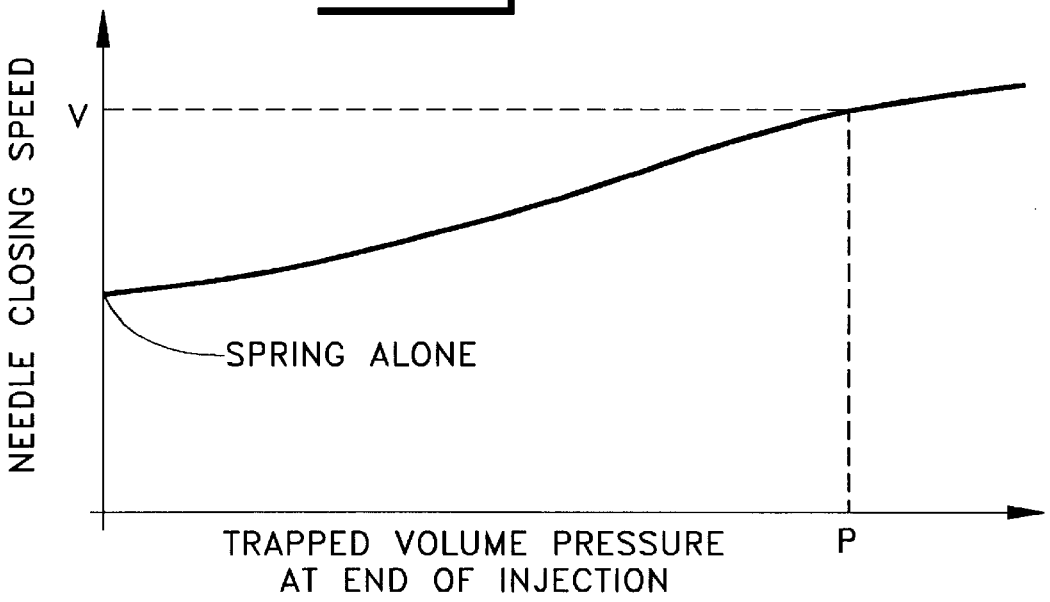
FIG. 3 is a graph of needle closing speed versus pressure in the trapped volume at the end of an injection event.

Referring now to FIG. 3, the speed at which the needle valve member is made to close can be varied significantly by the size of the pressure decay passage and other factors that influence how high the pressure in the trapped volume reaches at the end of an injection event. However, there comes a point where even a substantially large increase in pressure only results in a relatively small increase in the closing speed of the needle valve member.

Since fuel pressures are generally highest, and the time between injection events is shortest, at rated conditions, the pressure decay passage must be sized so that pressure can decay at rated conditions between injection events. One method at arriving at an appropriate diameter for the pressure decay port is to start a simulation with a port size that is known to be too large. The port size is steadily decreased in the simulation until it is too small to allow sufficient pressure decay between injection events at rated conditions. The diameter that is just large enough to allow sufficient pressure decay at rated conditions is preferably chosen.

The above description is intended for illustrative purposes only and is not intended to limit the scope of the present invention in any way. Those skilled in the art will no doubt realize that the illustrated embodiments can be modified in various ways without departing from the concepts embodied in the present invention, which is defined in terms of the claims set forth below.

We claim:

1. A fuel injector comprising:

an injector body defining a guide bore, a low pressure space, a trapped volume and a fuel pressurization chamber in fluid communication with a nozzle outlet;

a needle valve member positioned in said injector body and being movable between an inject position in which said fuel pressurization chamber is open to said nozzle outlet, and a closed position in which said nozzle outlet is blocked to said fuel pressurization chamber;

said needle valve member including a guide portion and a lifting hydraulic surface exposed to fluid pressure in said fuel pressurization chamber, and a closing hydraulic surface exposed to fluid pressure in said trapped volume;

at least one of said injector body and said needle valve member defining a pressure decay passage extending between said trapped volume and said low pressure space; and fluid communication between said trapped volume and said fuel pressurization chamber consists essentially of a clearance between said guide portion and said guide bore.

2. The fuel injector of claim 1 wherein said pressure decay passage is sufficiently restrictive to fluid flow that pressure in said trapped volume rises significantly above pressure in said low pressure space by an end of an injection event; but said pressure decay passage is sufficiently open to fluid flow that pressure in said trapped volume drops to said pressure in said low pressure space before a subsequent injection event.

3. The fuel injector of claim 1 wherein said pressure decay passage includes a cylindrically shaped pressure decay port defined by said injector body.

4. The fuel injector of claim 1 further comprising a compression spring operably positioned in said trapped volume to bias said needle valve member toward said closed position.

5. The fuel injector of claim 1 wherein;

said pressure decay passage includes a pressure decay port extending between said guide bore and said low pressure space.

6. The fuel injector of claim 5 wherein said injector body defines a nozzle chamber;

said lifting hydraulic surface is positioned in said nozzle chamber; and said pressure decay port opens into said guide bore at a location that is within 5% of a middle location between said trapped volume and said nozzle chamber.

7. The fuel injector of claim 1 wherein said pressure decay passage is a cylindrically shaped pressure decay port extending between said trapped volume and said low pressure space.

8. The fuel injector of claim 1 wherein said needle valve member includes a spacer positioned in said trapped volume; and said pressure decay passage includes a pressure decay port extending between said low pressure space and said trapped volume, and further includes a clearance area between said spacer and said trapped volume.

9. A fuel injector comprising:

an injector body defining a guide bore, a low pressure space, a trapped volume and a fuel pressurization chamber in fluid communication with a nozzle outlet;

a needle valve member positioned in said injector body and being movable between an inject position in which said fuel pressurization chamber is open to said nozzle outlet, and a closed position in which said nozzle outlet is blocked to said fuel pressurization chamber;

said needle valve member including a guide portion and a lifting hydraulic surface exposed to fluid pressure in said fuel pressurization chamber, and a closing hydraulic surface exposed to fluid pressure in said trapped volume;

at least one of said injector body and said needle valve member defining a pressure decay passage extending between said trapped volume and said low pressure space, and said pressure decay passage including a cylindrically shaped pressure decay port defined by said injector body;

a compression spring operably positioned in said injector body to bias said needle valve member toward said closed position; and fluid communication between said trapped volume and said fuel pressurization chamber consists essentially of a clearance between said guide portion and said guide bore.

10. The fuel injector of claim 9 wherein said pressure decay passage is sufficiently restrictive to fluid flow that pressure in said trapped volume rises significantly above pressure in said low pressure space by an end of an injection event; but said pressure decay passage is sufficiently open to fluid flow that pressure in said trapped volume drops to said pressure in said low pressure space before a subsequent injection event.

11. The fuel injector of claim 10 wherein said pressure decay passage includes a pressure decay port extending between said guide bore and said low pressure space.

12. The fuel injector of claim 11 wherein said injector body defines a nozzle chamber;

said lifting hydraulic surface is positioned in said nozzle chamber; and said pressure decay port opens into said guide bore at a location that is within 5% of a middle location between said trapped volume and said nozzle chamber.

13. The fuel injector of claim 10 wherein said pressure decay passage is a cylindrically shaped pressure decay port extending between said trapped volume and said low pressure space.

14. The fuel injector of claim 10 wherein said needle valve member includes a spacer positioned in said trapped volume; and said pressure decay passage includes a pressure decay port extending between said low pressure space and said trapped volume, and further includes a clearance area between said spacer and said trapped volume.

15. A nozzle assembly comprising:

a body defining a guide bore, a fuel circulation passage, a trapped volume and a nozzle chamber in fluid communication with a nozzle outlet;

a needle valve member positioned in said body and being movable between an inject position in which said nozzle chamber is open to said nozzle outlet, and a closed position in which said nozzle outlet is blocked to said nozzle chamber;

said needle valve member including a guide portion, a lifting hydraulic surface exposed to fluid pressure in said nozzle chamber, and a closing hydraulic surface exposed to fluid pressure in said trapped volume;

at least one of said injector body and said needle valve member defining a pressure decay passage extending between said trapped volume and said fuel circulation passage;

said pressure decay passage being sufficiently restrictive to fluid flow that pressure in said trapped volume rises significantly above pressure in said fuel circulation passage by an end of an injection event, but said pressure decay passage is sufficiently open to fluid flow that pressure in said trapped volume drops to said pressure in said fuel circulation passage before a subsequent injection event; and fluid communication between said trapped volume and said fuel pressurization chamber consists essentially of a clearance between said guide portion and said guide bore.

16. The nozzle assembly of claim 15 wherein said body includes a casing component, a tip component, a spring cage component and a spacer component;

said trapped volume being defined by said tip component, said spring cage component and said spacer component; and a portion of said fuel circulation passage being an area between said spring cage component and said casing component.

17. The nozzle assembly of claim 16 wherein said tip component defines said nozzle outlet, said nozzle chamber and said guide bore.

18. The nozzle assembly of claim 16 further comprising a compression spring operably positioned in said trapped volume to bias said needle valve member toward said closed position.

19. The nozzle assembly of claim 16 wherein said pressure decay passage includes a cylindrically shaped bore.

20. The nozzle assembly of claim 15 wherein said pressure decay passage includes a pressure decay port extending between said guide bore and said fuel circulation passage, and said pressure decay port opens into said guide bore at a location that is within 5% of a middle location between said trapped volume and said nozzle chamber.

* * * * *